United States Patent [19]

Andress et al.

[11] 4,257,737

[45] Mar. 24, 1981

[54] COOLED ROTOR BLADE

[75] Inventors: Dale E. Andress; Douglas H. Clevenger, both of Palm Beach Gardens, Fla.

[73] Assignee: United Technologies Corporation, Hartford, Conn.

[21] Appl. No.: 923,421

[22] Filed: Jul. 10, 1978

[51] Int. Cl.[3] ..... F01D 5/18

[52] U.S. Cl. ..... 416/97 R; 415/115

[58] Field of Search ..... 416/95–97; 415/115, 116, 175

[56] References Cited

U.S. PATENT DOCUMENTS

| | | | |
|---|---|---|---|
| 3,370,829 | 2/1968 | Banthin et al. | 415/115 |
| 3,528,751 | 9/1970 | Quinones et al. | 415/115 |
| 3,533,711 | 10/1970 | Kercher | 415/116 X |
| 3,628,885 | 12/1971 | Sidenstick et al. | 416/97 |
| 3,644,059 | 2/1972 | Bryan | 416/97 A |
| 3,799,696 | 3/1974 | Redman | 416/97 |
| 3,891,348 | 6/1975 | Auxier | 416/96 A X |
| 3,930,748 | 1/1976 | Redman et al. | 416/97 A |
| 4,019,831 | 4/1977 | Franklin et al. | 416/96 A X |
| 4,026,659 | 5/1977 | Freeman | 415/116 X |
| 4,073,599 | 2/1978 | Allen et al. | 416/97 R |
| 4,162,136 | 7/1979 | Parkes | 416/97 R |

FOREIGN PATENT DOCUMENTS

| | | | |
|---|---|---|---|
| 364747 | 3/1973 | U.S.S.R. | 416/97 |

OTHER PUBLICATIONS

Gas Turbine International, Jul.–Aug. 1977, vol. 18, No. 4, p. 51.

*Primary Examiner*—Everette A. Powell, Jr.
*Attorney, Agent, or Firm*—Jack N. McCarthy

[57] ABSTRACT

A cooled rotor blade is constructed having a cooling passage extending from the root and through the airfoil shaped section in a serpentine fashion, making several passes between the bottom and top thereof; a plurality of openings connect said cooling passage to the trailing edge; a plurality of compartments are formed lengthwise behind the leading edge of the blade; said compartments having openings extending through to the exterior forward portion of the blade; and sized openings connect the cooling passage to each of the compartments to control the pressure in each compartment.

1 Claim, 6 Drawing Figures

FIG. 2
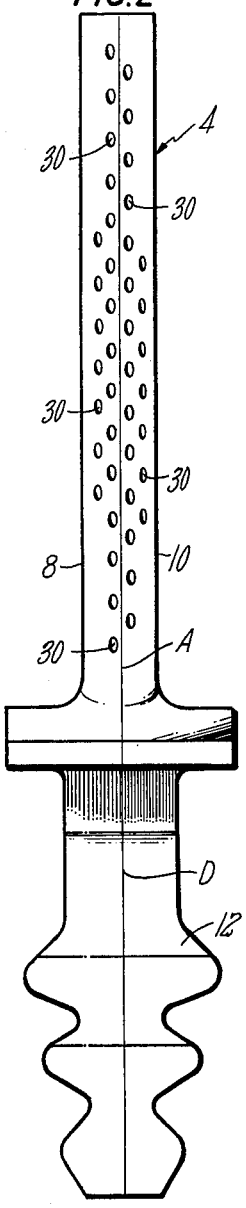
FIG. 1
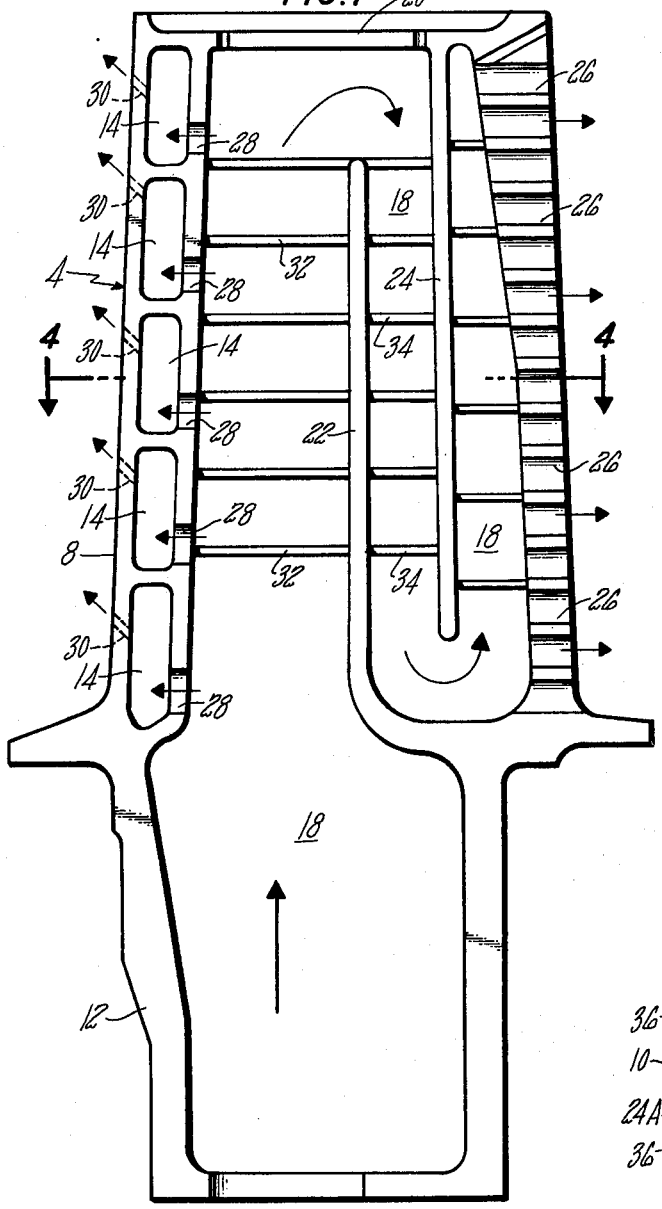
FIG. 5
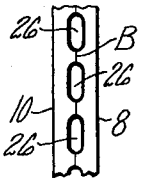
FIG. 6
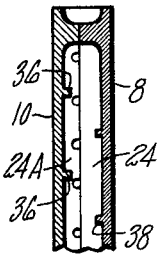
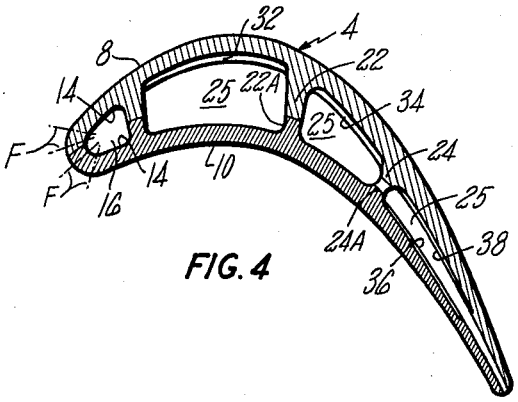
FIG. 4
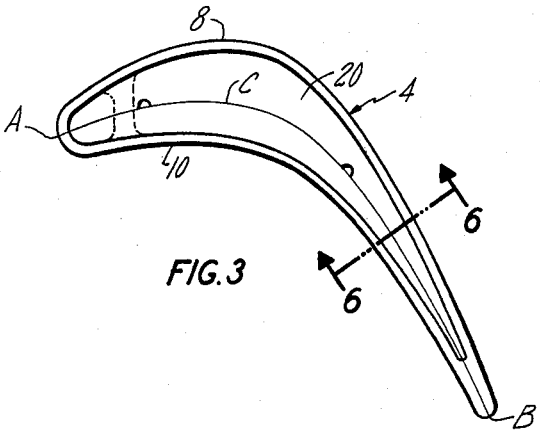
FIG. 3

COOLED ROTOR BLADE

The invention disclosed herein was made in the performance of or under a contract with the Department of the Air Force.

BACKGROUND OF THE INVENTION

This invention relates to the construction of a blade wherein blade cooling is desired. Many constructions of cooled rotor blades with various constructions of leading edges appear in the prior art and some patents showing different leading edge constructions are U.S. Pat. Nos. 3,606,572; 3,240,468; 3,647,316; and 3,656,863.

SUMMARY OF THE INVENTION

A primary object of the present invention is to provide a cooled rotor blade having a plurality of compartments extending lengthwise along the length of the blade wherein cooling flow is directed to the compartments and then to the exterior of the blade with the pressure in the compartments being controlled by metering the flow to the compartments.

Another object of the invention is to provide a cooled rotor blade wherein pressure ratios along the span of a blade can be controlled, enabling more efficient use of cooling air and obtaining higher cooling effectiveness while requiring less cooling air.

A further object of the present invention is to direct metered flow to compartments located behind the leading edge of a blade so that it impinges against the inner surface of the blade.

BRIEF DESCRIPTION OF THE DRAWINGS

FIG. 1 is a view of a mating surface of the suction side of a two-piece blade;

FIG. 2 is a view of the leading edge of the two-piece blade assembled;

FIG. 3 is a top view of the two-piece blade assembled;

FIG. 4 is a view taken along the line 4—4 of FIG. 1 showing a section of an assembled blade;

FIG. 5 is a fragmentary view of the trailing edge of the two-piece blade assembled; and FIG. 6 is a fragmentary view taken along the line 6—6 in FIG. 3 starting at the top of the assembled blade.

DESCRIPTION OF THE PREFERRED EMBODIMENT

The blade 4 is similar to engine turbine blades such as shown in U.S. Pat. No. 3,836,279, and can be mounted in a similar manner with the root 12 of the blade fixed in the mating slots of a conventional rotor disc (not shown). Blade 4 is formed in two parts, 8 and 10, with the parts meeting along the leading edge at A and along the trailing edge at B. The meeting line extends across the top of the blade 4 at C and extends around substantially the center of the root section as at D. Part 10 includes the pressure side of the blade, while part 8 includes the suction side of the blade.

While this blade 4 is formed in two parts, it can be constructed in other ways. One method is shown in U.S. Pat. No. 3,872,563, and another method is shown in U.S. Pat. No. 3,301,526.

The two parts, 8 and 10, of the blade 4, are formed having their mating faces contoured to provide desired passageways and compartments therein, while providing the outer airfoil shaped section and root. As seen in FIG. 1, the forward portion of each part 8 has a plurality of recessed portions 14 placed therein, and the forward portion of each part 10 also has a plurality of mating recessed portions 14 placed therein. When the blade parts 8 and 10 are bonded together, or fixed by any other means desired, the mating recessed portions 14 form a plurality of compartments 16 lengthwise behind the leading edge of the blade (see FIG. 4). A serpentine passageway 18 is formed in the meeting face of the part 8 and extends from the lower part of the root 12 of the blade 4 to the top 20 of the blade where it is directed downwardly between two wall sections 22 and 24 to the top of the root section 12 where it is directed upwardly between wall section 24 and the trailing edge of the blade. A similar serpentine passageway is formed in the mating face of the part 10 with the wall sections 22 and 24 of part 8 engaging their counterparts 22A and 24A in part 10 to form an enclosed serpentine passage 25. The serpentine passage 25 located rearwardly of the wall sections 24 and 24A is connected to the trailing edge by short passageways 26. These can be directed to the trailing edge in any manner desired to achieve desired cooling.

The leading portion of the blade 4 is formed having a plurality of openings 30 therein connected to the different compartments 16 to achieve a desired pattern of cooling. One representative opening 30 is shown by dotted lines connected to each of the recessed portions 14 in FIG. 1. Center lines for these openings 30 are shown by phantom lines F in FIG. 4. The plurality of compartments 16 are also connected to the serpentine passage 25 by sized or metered openings 28. It is noted that the flow of cooling fluid through the openings 28 will impinge on the inner surface of the leading edge portion of the blade 4.

Ribs 32 and 34 are placed along the inner side of the suction side of the blade in the two parts of the serpentine passageway 18 forward of wall 24, while staggered ribs 36 and 38 are placed between the inner side of the suction side and pressure side in the serpentine passage 25 rearward of the wall sections 24 and 24A.

The internal pressure in each of the compartments 16 is controlled by sizing the openings 28. By radially controlling the cooling air supply pressures, desired pressure ratios along the span can be obtained.

We claim:

1. A cooled rotor blade having an airfoil shaped section and a root section including, a cooling passage extending from the root section into the airfoil shaped section, a plurality of compartments being located lengthwise in line in a radial direction behind only the leading edge of the blade, each compartment having cooling openings extending through the leading edge to the exterior of the airfoil shaped section of the blade to achieve a desired pattern of cooling, adjacent lengthwise compartments having a common wall, a sized opening connecting the cooling passage to each of the compartments to control the pressure in each compartment, each sized opening being located at the bottom of its lengthwise compartment.

* * * * *